US006106440A

United States Patent [19]

Olbrish, Jr.

[11] Patent Number: 6,106,440

[45] Date of Patent: Aug. 22, 2000

[54] WHEELCHAIR EXERCISE SYSTEM

[76] Inventor: Stephen R. Olbrish, Jr., 13631 Weald Green St., Dallas, Tex. 72540

[21] Appl. No.: 09/226,256

[22] Filed: Jan. 7, 1999

[51] Int. Cl.[7] ..... A63B 22/06

[52] U.S. Cl. ..... 482/57; 482/60; 280/234; 280/304.1

[58] Field of Search ..... 482/57, 60, 62; 272/73; 128/25; 280/233, 234, 244, 250, 250.1, 261, 288.4, 304.1

[56] References Cited

U.S. PATENT DOCUMENTS 4,705,284 11/1987 Stout ..... 280/242

4,773,399 9/1988 Richardson ..... 128/25 R 5,324,060 6/1994 Van Vooren et al. ..... 280/304.1

*Primary Examiner*—Jerome W. Donnelly

*Assistant Examiner*—Tam Nguyen

[57] ABSTRACT

A wheelchair exercise system for allowing wheelchair users to strengthen, rehabilitate, and develop their muscles. The wheelchair exercise system includes a wheelchair with a frame having a pair of downwardly depending front legs. A cross portion of a front yoke is mounted to the front legs of the wheelchair. A front axle is rotatably mounted to a forwards extent of the front yoke which extends from the cross portion. A pair of front wheels are coupled to the front axle. A pair of foot pedals are coupled to the front axle to rotate the front axle.

6 Claims, 4 Drawing Sheets

10
30
29
11
31
33
34
22
27
26
19
20
18
16
14

30
10
11
13
29
12
15
14
3
17
16
4
18
20
4
19
23
21
52
3
51
26
22

WHEELCHAIR EXERCISE SYSTEM

BACKGROUND OF THE INVENTION

1. Field of the Invention

The present invention relates to wheelchair exercisers and more particularly pertains to a new wheelchair exercise system for allowing a wheelchair user to strengthen, rehabilitate, and develop their muscles.

2. Description of the Prior Art

The use of wheelchair exercisers is known in the prior art. More specifically, wheelchair exercisers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,572,501 by Durham et al.; U.S. Pat. No. 5,242,179 BY Beddome et al.; U.S. Pat. No. 3,423,086 by Moore; U.S. Pat. No. Des. 277,089; U.S. Pat. No. 2,630,332 by Pettijohn; and U.S. Pat. No. 4,471,972by Young which are all herein incorporated by reference.

While these devices fulfill their respective, particular objectives and requirements, the aforementioned patents do not disclose a new wheelchair exercise system. The inventive device includes a wheelchair with a frame having a pair of downwardly depending front legs. A cross portion of a front yoke is mounted the front legs of the wheelchair. A front axle is rotatably mounted to a forwards extent of the front yoke which extends from the cross portion. A pair of front wheels are coupled to the front axle. A pair of foot pedals is coupled to front axle to rotate the front axle.

In these respects, the wheelchair exercise system according to the present invention substantially departs from the conventional concepts and designs of the prior art, and in so doing provides an apparatus primarily developed for the purpose of allowing a wheelchair user to strengthen, rehabilitate, and develop their muscles.

SUMMARY OF THE INVENTION

In view of the foregoing disadvantages inherent in the known types of wheelchair exercisers now present in the prior art, the present invention provides a new wheelchair exercise system construction wherein the same can be utilized for allowing a wheelchair user to strengthen, rehabilitate, and develop their muscles.

The general purpose of the present invention, which will be described subsequently in greater detail, is to provide a new wheelchair exercise system apparatus and method which has many of the advantages of the wheelchair exercisers mentioned heretofore and many novel features that result in a new wheelchair exercise system which is not anticipated, rendered obvious, suggested, or even implied by any of the prior art wheelchair exercisers, either alone or in any combination thereof.

To attain this, the present invention generally comprises a wheelchair with a frame having a pair of downwardly depending front legs. A cross portion of a front yoke is mounted to the front legs of the wheelchair. A front axle is rotatably mounted to a forwards extent of the front yoke which extends from the cross portion. A pair of front wheels are coupled to the front axle. A pair of foot pedals is coupled to the front axle to rotate the front axle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art,who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the present invention to provide a new wheelchair exercise system apparatus and method which has many of the advantages of the wheelchair exercisers mentioned heretofore and many novel features that result in a new wheelchair exercise system which is not anticipated, rendered obvious, suggested, or even implied by any of the prior art wheelchair exercisers, either alone or in any combination thereof.

It is another object of the present invention to provide a new wheelchair exercise system which may be easily and efficiently manufactured and marketed.

It is a further object of the present invention to provide a new wheelchair exercise system which is of a durable and reliable construction.

An even further object of the present invention is to provide a new wheelchair exercise system which is susceptible of a low cost of manufacture with regard to both materials and labor, and which accordingly is then susceptible of low prices of sale to the consuming public, thereby making such wheelchair exercise system economically available to the buying public.

Still yet another object of the present invention is to provide a new wheelchair exercise system which provides in the apparatuses and methods of the prior art some of the advantages thereof, while simultaneously overcoming some of the disadvantages normally associated therewith.

Still another object of the present invention is to provide a new wheelchair exercise system for allowing a wheelchair user to strengthen, rehabilitate, and develop their muscles.

Yet another object of the present invention is to provide a new wheelchair exercise system which includes a wheelchair with a frame having a pair of downwardly depending front legs. A cross portion of a front yoke is mounted to the front legs of the wheelchair. A front axle is rotatably mounted to a forwards extent of the front yoke which extends from the cross portion. A pair of front wheels are coupled to the front axle. A pair of foot pedals is coupled to front axle to rotate the front axle.

Still yet another object of the present invention is to provide a new wheelchair exercise system that that may be attached to preexisting wheelchairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
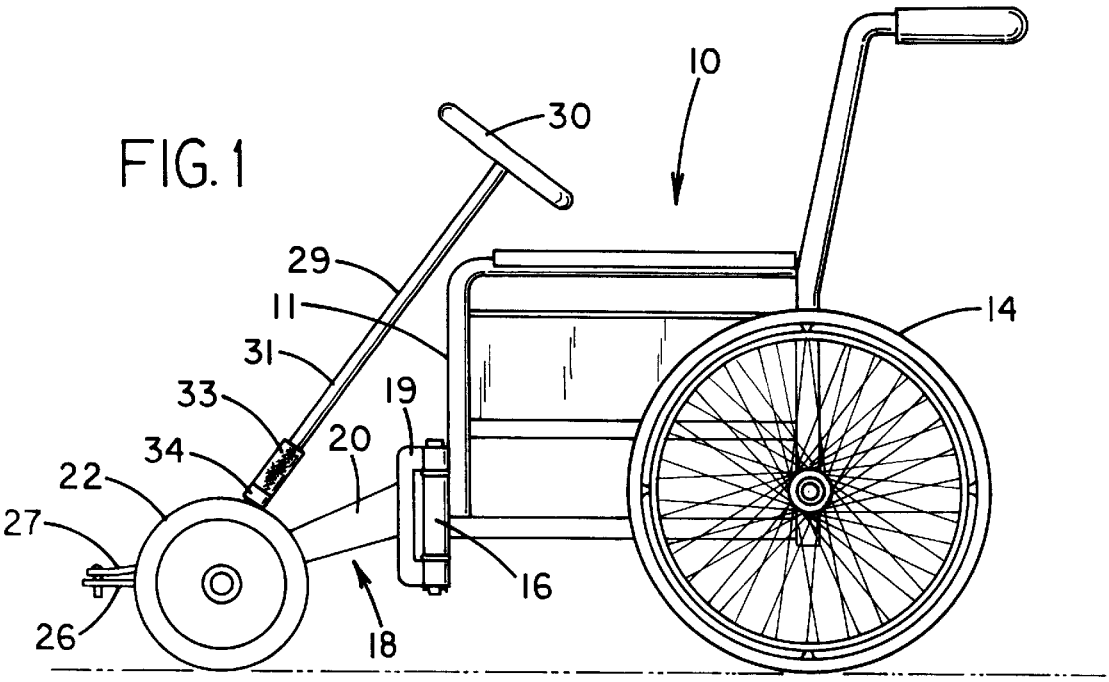
FIG. 1 is a schematic side view of a new wheelchair exercise system according to the present invention.

With reference now to the drawings, and in particular to FIGS. 1 through 9 thereof, a new wheelchair exercise system embodying the principles and concepts of the present invention will be described.

As best illustrated in FIGS. 1 through 9, the wheelchair exercise system generally comprises a wheelchair with a frame having a pair of downwardly depending front legs. A cross portion of a front yoke is mounted to the front legs of the wheelchair. A front axle is rotatably mounted to a forwards extent of the front yoke which extends from the cross portion. A pair of front wheels are coupled to the front axle. A pair of foot pedals is coupled to the front axle to rotate the front axle.

In closer detail, the wheelchair 10 has a frame 11, a seat 12 coupled to the frame, a backrest 13 coupled to the frame and upwardly extending from the seat. The frame of the wheelchair has a pair of ground rear wheels 14,15 rotatably mounted thereto and a pair of downwardly depending front legs 16,17 each designed for mounting a front caster wheels thereto.

Figure 2:
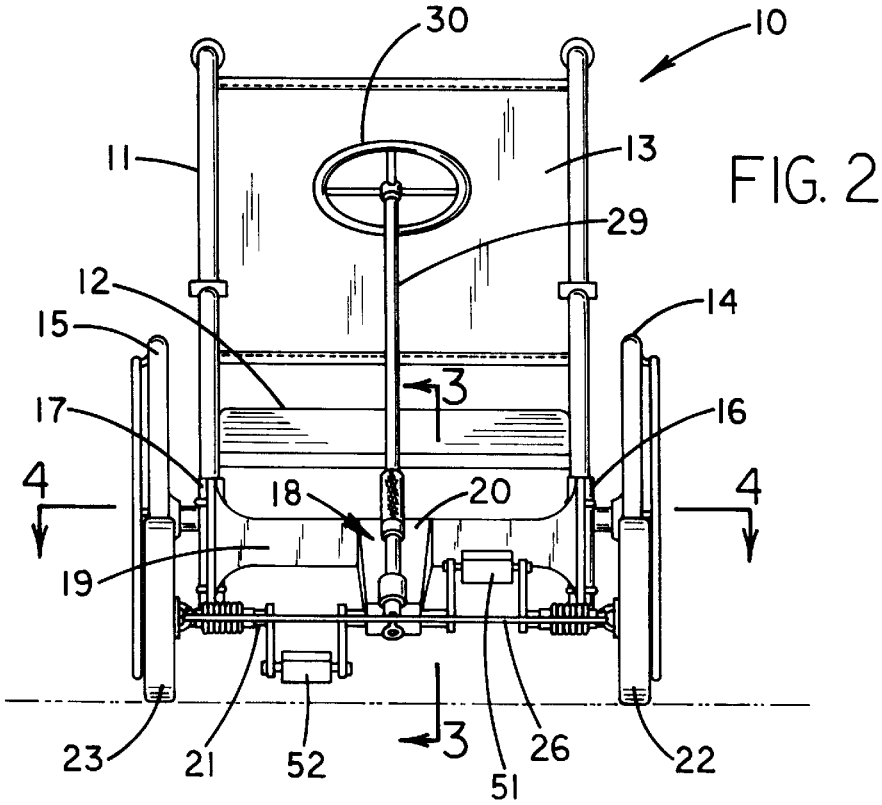
FIG. 2 is a schematic front view of the present invention.
Figure 3:
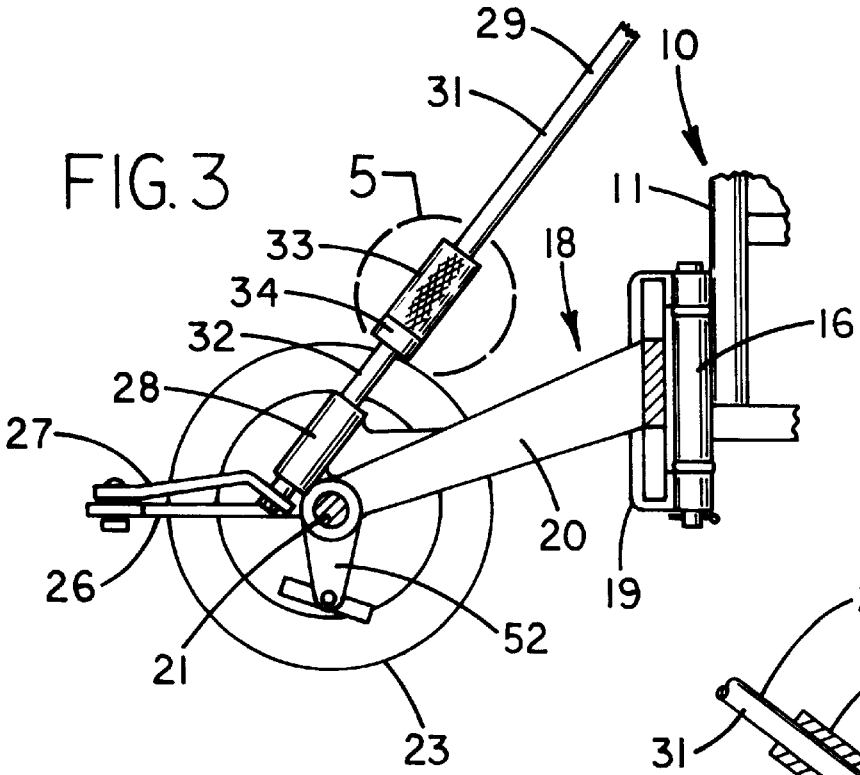
FIG. 3 is a schematic cross sectional side view taken from line 3—3 of FIG. 2.

In a leg exercising embodiment of the invention illustrated in FIGS. 1, 2, 3, 4 and 5, a front yoke 18 is provide having a cross portion 19 and a forwards extent 20 outward extending from the cross portion. The cross portion of the front yoke has a pair of opposite ends. As best illustrated in FIGS. 1, 2, and 3, a first end of the cross portion of the front yoke is mounted to a first leg of the front legs of the wheelchair and a second end of the cross portion of the front yoke is mounted to a second leg of the front legs of the wheelchair. The forwards extent of the front yoke is forwardly extended from the front legs of the first wheelchair.

A front axle 21 is rotatably mounted to the forwards extent of the front yoke to permit free rotation of the front axle about an generally horizontal axis extending generally perpendicular to the forwards extent of the front yoke. The front axle has a pair of opposite ends. The ends of the front axle each have a ground engaging front wheel 22,23 coupled thereto. Preferably, the front axle has a spaced apart pair of flexible regions 24,25 where the front axle may be bent. Ideally, the flexible regions each comprise a universal pivot joint covered in a resiliently deformable corrugated tubular sleeve. In use, the flexible regions permit turning side to side of the front wheels while still permitting rotation of the front axle such the front wheels rotate and vice versa.

Figure 4:
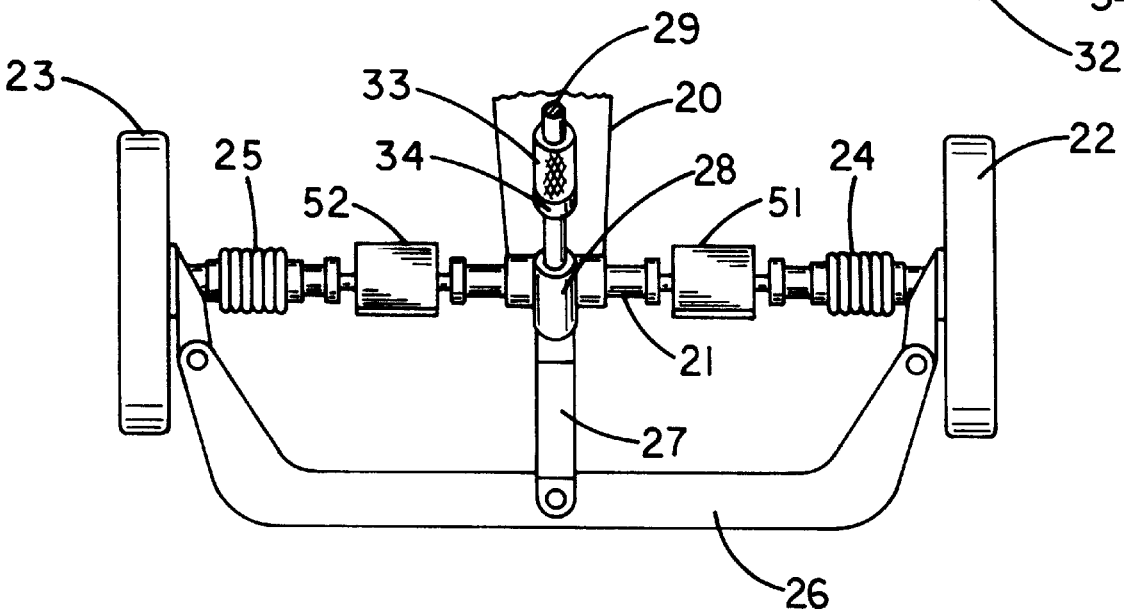
FIG. 4 is a schematic cross sectional top view taken from line 4—4 of FIG. 2.

A steering bar 26 is provided having a pair of opposite ends. As illustrated in FIG. 4, one of the ends of the steering bar is pivotally coupled to one of the front wheels and the other of the ends of the steering bar is pivotally coupled to the other of the front wheels so that lateral movement of the steering bar in turn pivots the front wheels side to side. An elongate steering lever 27 is pivotally coupled to the steering bar between the ends of the steering bar. The steering lever is extended from the steering bar towards the forwards extent of the front yoke.

The forwards extent has a column sleeve 28 coupled thereto. An elongate steering column 29 is extended through the column sleeve to permit free rotation of the steering column in the column sleeve. The steering column has opposite upper and lower ends, the lower end of the steering column is coupled to the steering lever such that rotation of the steering column leads to the pivoting between the steering lever and the steering bar to turn the front wheels accordingly. A steering wheel 30 is coupled to the upper end of the steering column to aid a user in turning the steering column.

Figure 5:
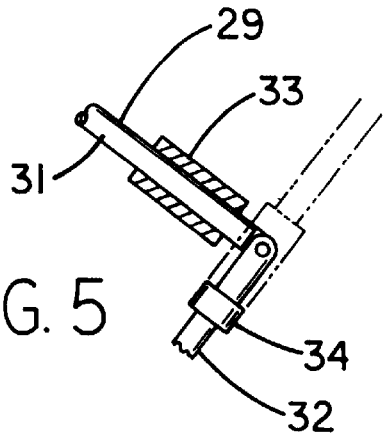
FIG. 5 is a schematic enlarged view of the pivoting of the portions of the steering column taken from the circular 5 on FIG. 3.

Preferably, the steering column has upper and lower portions 31,32. The upper portion of the steering column is positioned adjacent the upper end of the steering column and the lower portion of the steering column is positioned adjacent the lower end of the steering column. As illustrated in FIG. 5, the upper and lower portions of the steering column are pivotally coupled together at a pivot coupling to permit pivoting of the steering column forwardly away from the wheelchair to permit a user to get in and out of the wheelchair.

In this preferred embodiment, the steering column has a collar 33 slidably disposed therearound. The lower portion of the steering column has a stop flange 34 adjacent the pivot coupling between the upper and lower portions of the steering column. As illustrated in FIG. 3, the collar of the steering column abuts the stop flange such that the pivot coupling between the upper and lower portions of the steering column is positioned in the collar to hold the upper and lower portions of the steering column in a fixed position with respect to one another.

A pair of foot pedals 51,52 are coupled to the front axle between the flexible regions. In use, the foot pedals are designed to be pushed with the feet of a user to rotate the front axle and thereby rotate the front wheels.

Figure 6:
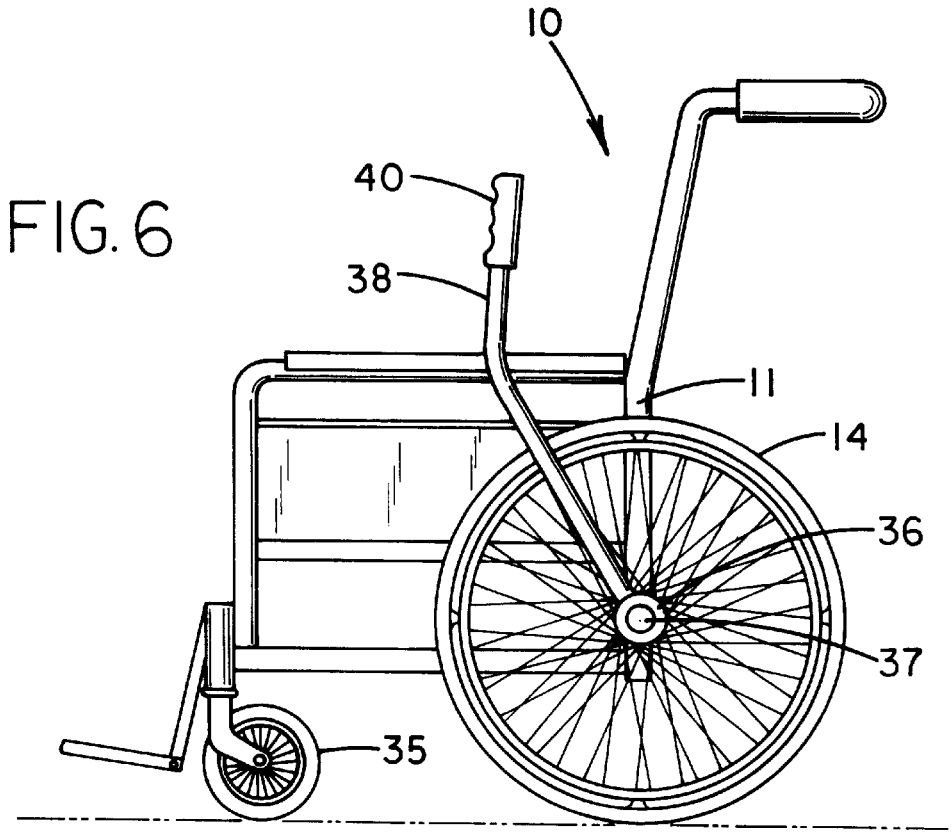
FIG. 6 is a schematic side view of the arm exercising embodiment of the present invention.
Figure 7:
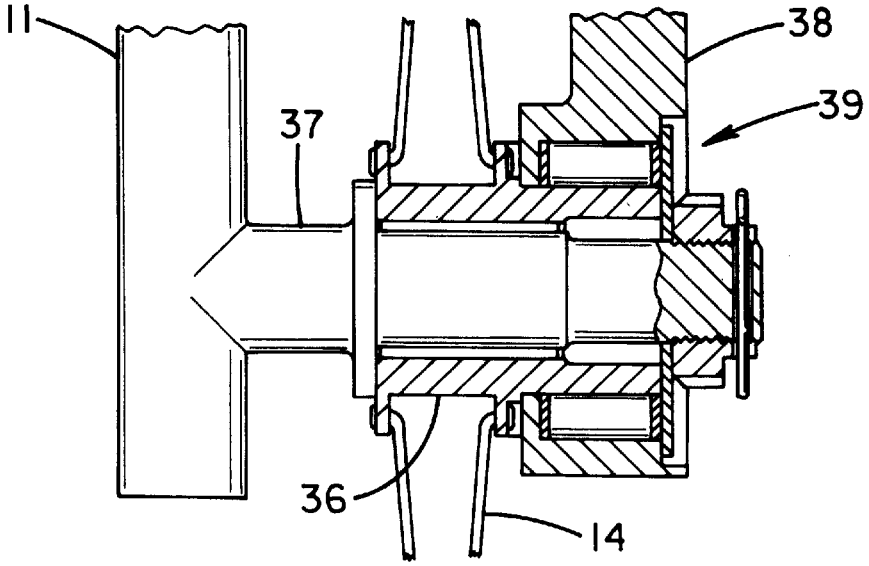
FIG. 7 is a schematic enlarged cross sectional view of a rear wheel of the embodiment of the present invention illustrated in FIG. 6.

FIGS. 6 and 7 illustrate an arm and upper torso exercising embodiment of the system. In this embodiment, the front legs of a second of the wheelchairs each have a traditional wheelchair ground engaging front wheel 35 rotatably mounted thereto. As best illustrated in FIG. 7, each of the rear wheels has a hub 36 disposed about an associated rear axle 37 extending from the frame of the second wheel chair to rotatably connect the respective rear wheel to the frame of the second wheelchair.

Each of the rear wheels of the second wheelchair has an elongate lever 38 pivotally coupled to the hub of the respective rear wheel by a ratchet mechanism 39 or a tension mechanism whereby pivoting of each lever rotates the associated rear wheel in a first direction. In use, pivoting the levers in one direction causes the rear wheels to rotate in the first direction while pivoting the levers back in an opposite direction does not interfere with the rotation of the rear wheels in their first direction. Preferably, each of the levers has a resiliently deformable upper handle 40 designed for gripping by the hands of the user.

Figure 8:
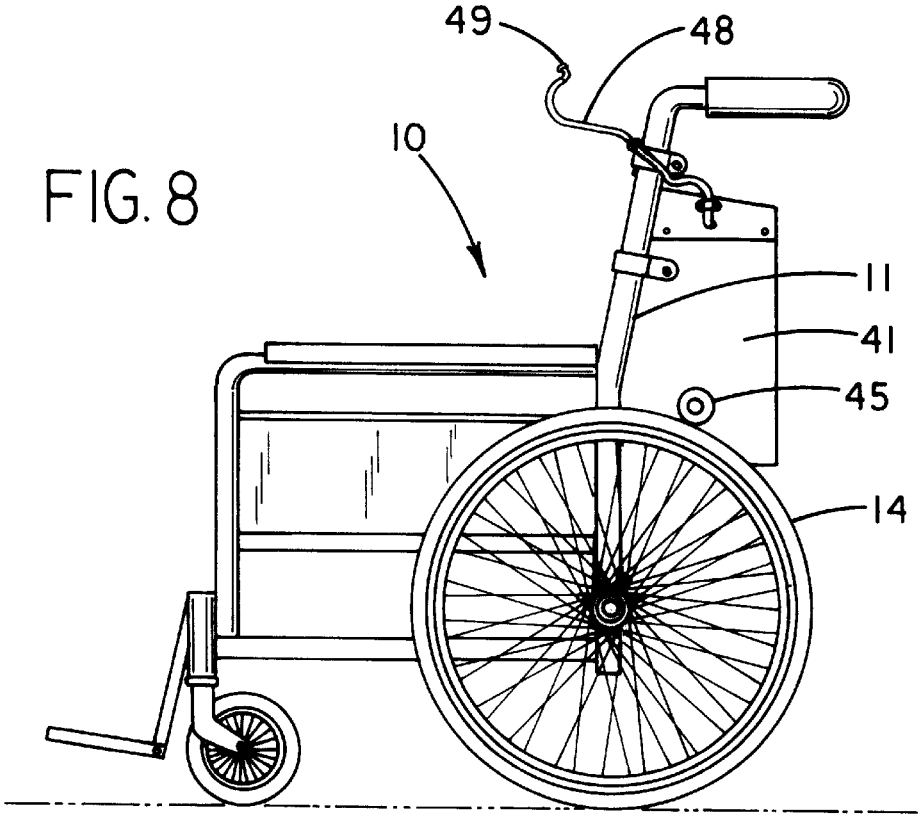
FIG. 8 is a schematic side view of a lung and torso exercising embodiment of the present invention.
Figure 9:
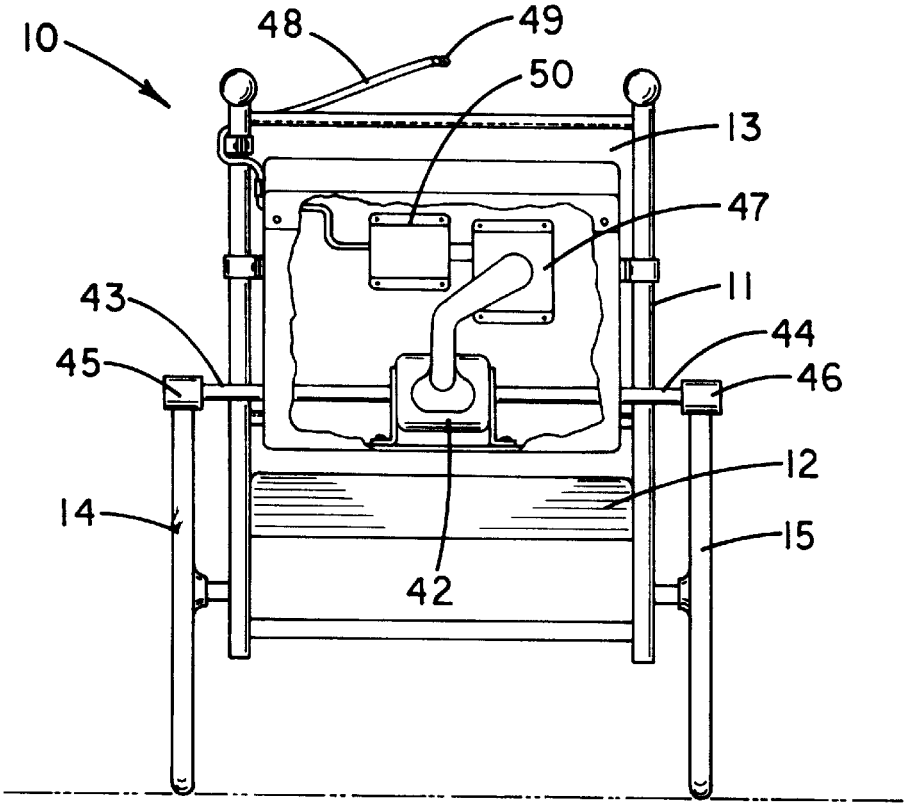
FIG. 9 is a schematic breakaway rear view of the embodiment of the present invention illustrated in FIG. 8.

FIGS. 8 and 9 illustrate a third embodiment of the system for exercising the lungs and related torso muscles of a user. In this embodiment, a housing 41 is mounted to the backrest of the wheelchair. As illustrated in FIG. 9, a motor 42 is mounted in the housing. The motor has a pair of rotatable drive shafts 43,44 extending in opposite directions from one another. In use, the motor rotates the drive shafts when energized.

The drive shafts each are outwardly extended through the housing and each terminates at an outer end. The outer ends of the drive shafts each has a roller 45,46 coupled thereto. As best illustrated in FIG. 9, a first of the rollers engages a first of the rear wheels of the wheelchair while a second of the rollers engages a second of the rear wheels of the whereby rotation of each drive shaft rotates the rear wheel engaging the associated roller. Ideally, the rollers each comprise a resiliently compressible rubber material to frictionally enhance contact between each rear wheel and their associated roller.

An energy converter 47 is provided in the housing has a turbine and is electrically connected to the motor. An elongate flexible tube 48 is in fluid communication with the turbine of the energy converter. The flexible tube has an open free end 49 outwardly extending from the housing. The free end of the flexible tube is designed for insertion into a user's mouth to permit the user to blow of air through the flexible tube to the energy converter to rotate the turbine. Preferably, a sensor 50 is provided in the housing and in communication between the tube and the energy converter. The sensor detects when air is being blown through the tube into the energy converter to activate the energy converter. In use, the energy converter producing electrical energy for energizing the motor when the turbine is rotated by air blown through the flexible tube so that the motor rotates the drive shafts and thereby rotates the rear wheels to propel the wheelchair.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A wheelchair exercise system, comprising:

a wheelchair having a frame, a seat coupled to said frame, a backrest coupled to said frame and upwardly extending from said seat;

said frame of said wheelchair having a pair of ground rear wheels rotatably mounted thereto and a pair of downwardly depending front legs;

a front yoke having a cross portion and a forwards extent outward extending from said cross portion;

said cross portion of said front yoke having a pair of opposite ends;

a first of said ends of said cross portion of said front yoke being mounted to a first of said front legs of said wheelchair, a second of said ends of said cross portion of said front yoke being mounted to a second of said front legs of said wheelchair;

a front axle being rotatably mounted to said forwards extent of said front yoke;

said front axle having a pair of opposite ends;

said ends of said front axle each having a ground engaging front wheel coupled thereto; and a pair of foot pedals being coupled to said front axle.

2. The wheelchair exercise system of claim 1, wherein said front axle has a spaced apart pair of flexible regions, and wherein a steering bar is provided having a pair of opposite ends, one of said ends of said steering bar being pivotally coupled to one of said front wheels, the other of said ends of said steering bar being pivotally coupled to the other of said front wheels.

3. The wheelchair exercise system of claim 2, wherein an elongate steering lever is pivotally coupled to said steering bar between said ends of said steering bar, said steering lever being extended from said steering bar towards said forwards extent of said front yoke.

4. The wheelchair exercise system of claim 3, wherein said forwards extent has a column sleeve coupled thereto, and wherein an elongate steering column is extended through said column sleeve to permit free rotation of said steering column in said column sleeve, said steering column having opposite upper and lower ends, said lower end of said steering column being coupled to said steering lever, a steering wheel being coupled to said upper end of said steering column.

5. The wheelchair exercise system of claim 4, wherein said steering column has upper and lower portions, said upper portion of said steering column being positioned adjacent said upper end of said steering column, said lower portion of said steering column being positioned adjacent said lower end of said steering column, said upper and lower portions of said steering column being pivotally coupled together at a pivot coupling.

6. The wheelchair exercise system of claim 5, wherein said steering column has a collar slidably disposed therearound, wherein said lower portion of said steering column has a stop flange adjacent said pivot coupling between said upper and lower portions of said steering column, said collar of said steering column abutting said stop flange such that said pivot coupling between said upper and lower portions of said steering column is positioned in said collar to hold said upper and lower portions of said steering column in a fixed position with respect to one another.

* * * * *